US010646396B2

(12) United States Patent
Lass

(10) Patent No.: US 10,646,396 B2
(45) Date of Patent: May 12, 2020

(54) HYBRID MOBILITY AND TRANSFER ASSISTANCE DEVICE

(71) Applicant: James Lass, Antioch, IL (US)

(72) Inventor: James Lass, Antioch, IL (US)

( * ) Notice: Subject to any disclaimer, the term of this patent is extended or adjusted under 35 U.S.C. 154(b) by 0 days.

(21) Appl. No.: 16/225,000

(22) Filed: Dec. 19, 2018

(65) Prior Publication Data

US 2019/0192374 A1 Jun. 27, 2019

Related U.S. Application Data

(60) Provisional application No. 62/608,711, filed on Dec. 21, 2017.

(51) Int. Cl.

| | |
|---|---|
| ***A61H 3/04*** | (2006.01) |
| ***A61G 5/14*** | (2006.01) |
| ***A61G 7/10*** | (2006.01) |
| ***A61G 5/12*** | (2006.01) |
| ***A61G 5/10*** | (2006.01) |

(52) U.S. Cl.

CPC ..... *A61H 3/04* (2013.01); *A61G 5/1002* (2013.01); *A61G 5/122* (2016.11); *A61G 5/14* (2013.01); *A61G 7/1038* (2013.01); *A61G 7/1046* (2013.01); *A61H 2003/046* (2013.01); *A61H 2201/0161* (2013.01); *A61H 2201/1633* (2013.01); *A61H 2201/1635* (2013.01)

(58) Field of Classification Search

CPC ..... A61H 3/04; A61G 5/14

See application file for complete search history.

(56) References Cited

U.S. PATENT DOCUMENTS

| | | | | |
|---|---|---|---|---|
| 1,971,583 | A | 8/1934 | Skinner | |
| 2,374,182 | A | 4/1945 | Sam | |
| 2,759,525 | A | 8/1956 | Ries | |
| 2,776,701 | A | 1/1957 | Denis | |
| 3,256,035 | A | 6/1966 | Garringer | |
| 4,162,101 | A | 7/1979 | McCague, Sr. et al. | |
| 4,212,493 | A | 7/1980 | Ledesky | |
| 5,005,599 | A * | 4/1991 | Cunningham | A61H 3/00 135/67 |
| 5,320,122 | A | 6/1994 | Jacobson, II et al. | |
| 5,405,187 | A * | 4/1995 | Soderlund | A61G 5/00 297/312 |
| 7,686,324 | B2 * | 3/2010 | Nishi | A61G 5/08 280/647 |
| 8,156,581 | B2 * | 4/2012 | Fogleman | A61G 7/1019 297/312 |
| 8,584,689 | B2 | 11/2013 | Calton | |

(Continued)

*Primary Examiner* — Noah Chandler Hawk

(74) *Attorney, Agent, or Firm* — Stephen T. Scherrer; Monique A. Morneault; Scherrer Patent & Trademark Law, P.C.

(57) ABSTRACT

The present disclosure relates to an improved mobility and transfer assistance device designed act as a stability device for the user, as well as, an improved transfer apparatus for assisting in the transfer of the user or patient from one location or position to another location or position. The present mobility and transfer assistance device can be used as both a mobility device, such as a walker or wheelchair, but is also designed to provide more stability and guidance to the user, thereby encouraging the user to perform many daily tasks independently with minimal assistance.

10 Claims, 8 Drawing Sheets

(56) References Cited

U.S. PATENT DOCUMENTS

| | | | | |
|---|---|---|---|---|
| 8,636,298 | B2 * | 1/2014 | Nimura | A61G 5/1005 280/250.1 |
| 9,016,715 | B2 * | 4/2015 | Moliner | A61G 5/042 180/907 |
| 2010/0163087 | A1 | 7/2010 | Catton | |
| 2017/0319425 | A1 | 11/2017 | Fulkerson | |

* cited by examiner

PATIENT ENTERS
FROM BEHIND

HYBRID MOBILITY AND TRANSFER ASSISTANCE DEVICE

TECHNICAL FIELD

The present disclosure relates to an apparatus or device for assisting with standing, walking, seating and transferring a person or patient with limited mobility from one location to another. More specifically, the present apparatus is a hybrid wheelchair/walker and transfer assistance device designed for assisting a person with limited mobility move from one place to another, or from one position to another, for example from sitting to standing. The device provides the user with greater self-mobility as able, and enables mobility and transfer of the user with less assistance from a caregiver, compared to a standard walker and wheelchair.

BACKGROUND

Whether through aging, illness or injury, many people eventually require some form of mobility assistance, often through use of a cane, walker or wheelchair. Furthermore, patients who are limited by their mobility are often on the path to losing even more mobility even with the assistance of a walker or wheelchair, thereby requiring more assistance from another person or caregiver as time goes on. Persons with greatly limited mobility often require specialized care from another person, including family members, a specialized caregiver at home, and in certain cases, require living at an assisted living or nursing home facility. Additionally, many patients and older adults need assistance transferring from one location to another, such as getting into and out of bed, into and out of chairs, and assistance in the bathroom. Standard devices for assisting in movement and transfer include canes, walkers and wheelchairs. However, even of these devices can have their own disadvantages and limitations.

For example, walkers, including those with wheels or rollators, are commonly used by those with limited mobility. Walkers typically provide the side-to-side stability, and permit the user to move around independently, with little to no assistance from a third party. However, if the user needs to rest, he or she may need to seek out a stable chair. Although some walkers include a seat, the seat is usually located in the front of the walker, which is not easily reached without assistance from a third party. Additionally, the seat on the walker is typically not designed to allow the seated person to be moved, as a wheelchair, but is meant only as a temporary resting surface.

Wheelchairs may be used by individuals on a temporary basis, or may require more permanent usage by those with extremely limited mobility, including from aging, injury and illness. However, by their nature, wheelchairs can be difficult to maneuver, and can also be difficult for transferring a person to and from the wheelchair, which often requires assistance from another person. Most wheelchairs have a secured back, which means that the user can enter and exit the chair only from one direction. This means that transferring a person from the wheelchair to another location, such as a bed, chair or even to a toilet or shower, typically requires the assistance of another person or caregiver.

Depending on a person's physical limitations, using a traditional walker or wheelchair may actually discourage an individual from using his or her own strength and muscles to move or transfer from one position to another. If a patient is not used to using, or continues to use, at least some muscles for standing and movement, the result may be even further deterioration and decline of mobility. For instances, for many individuals accomplishing even daily activities including, standing, getting into and out of bed, transferring into and out of the shower, into or out of a chair with minimal assistance from a caregiver, can help the individual maintain some of the necessary muscles and strength needed to accomplish these daily activities. Loss of strength and mobility may result in a patient requiring further specialized care outside of the home, including assisted living and nursing home care. Additionally, maintaining physical strength and mobility as able, may lessen the chance of further injury.

A need, therefore, exists for improved mobility and transfer assistance device that provides stability and mobility to the user, but which encourages the user to continue to assist him or herself with daily activities, as able. Specifically, a need exists for improved mobility and transfer assistance device that functions ideally as both a walker and a wheelchair, while also providing enhanced ease of transferability of the user from one location to another.

Moreover, a need exists for improved mobility and transfer assistance device which permits easy access to and exit from the apparatus, thereby allowing minimal assistance during transfer, and allowing the individual to accomplish the movements him or herself.

A need further exists for an improved mobility and transfer assistance device which provides the user with great stability while standing and moving under his/her own power without requiring additional assistance from a another person or caregiver.

A need further exists for an improved mobility and transfer assistance device which provides the user with more stability and maneuverability than a traditional walker, rollator or wheelchair.

SUMMARY

The present disclosure relates to an improved mobility and transfer assistance device designed to act as a stability device for the user, as well as, an improved transfer apparatus for assisting in the transfer of the user from one location to another, or for moving from one position to another. Depending on the strength of the user, the present apparatus may also provide the user with greater independence in terms of mobility and transferability, therefore requiring limited to minimal assistance from another person or caregiver. To accomplish these advantages, the present device provides parallel support bars and a moveable, cantilevered seating element, so the user can rest or be transported on the device either under the user's own power or by being pushed by another person when the seat is in a closed position and the user is seated. Additionally, when the seating element is in the open position, the user can easily move into the center of the device, or transfer from the device to another location or position, all while using the parallel support bars as continuous support.

To this end, in an embodiment of the present disclosure, an improved mobility and transfer assistance device is provided. The device comprises a frame, a support structure connected to the frame, a backrest disposed on the frame between the support structure, and, a seating element connected to the frame and positioned between the support structure. The backrest and seating element further comprise sections which are independently movable from one another, thereby enabling the device to be converted between a standing device, moving device and a seating device. Wheels can be included on the device, making it useful as a walker or wheelchair.

A mobility and transfer device convertible between a walking device and a seating device is provided. The device comprises a frame, a support structure connected to the frame, the support structure further comprising a first support bar and a second support bar spaced apart from and parallel to the first support bar, a cantilevered seating element connected to the frame and between the first support bar and the second support bar, a backrest connected to the first support bar and the second support bar and positioned vertically to the seat rest.

It is, therefore, an advantage and objective of the present disclosure to provide an improved mobility and transfer assistance device which permits easy access to and exit from the apparatus, thereby allowing minimal assistance and enhanced transfer of a user from one location or position to another location or position.

It is yet another advantage and objective of the present disclosure to provide an improved mobility and transfer assistance device that provides improved stability to the user for enhancing independent mobility so that the user can perform many daily tasks as able with minimal assistance.

Yet another advantage and objective of the present disclosure is to provide an improved mobility and transfer assistance device that provides a wheelchair function as needed, where the user can sit on the device and either propel the device him/herself, or be pushed by another person.

It is yet another advantage and objective of the present disclosure to provide an improved mobility and transfer assistance device that provides an independently moveable seating element and backrest both of which can be moved into a stored position providing clear access to the interior space of the device.

It is a further advantage of the present disclosure to provide an improved mobility and transfer assistance device having a cantilevered seating element providing clearance to the device when placed over another object, such as a chair, bed or toilet.

A further advantage of the present disclosure is to provide an improved mobility and transfer assistance device configured and convertible between a walking aid, a transportation aid, a seating aid and as a position/location transfer aid.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION

The present disclosure relates to an improved mobility and transfer assistance device designed act as a stability device for the user, as well as, an improved transfer apparatus for assisting in the transfer of the user from one location or position to another location or position. The present mobility and transfer assistance device can be used as both a mobility device, such as a walker or wheelchair, but also functions to provide more stability to the user, encouraging the user to perform many daily tasks with ideally minimal assistance. Thus, a goal of the present device is to enable a person with limited mobility to remain as independent as possible, and to encourage a person to continue to perform as many daily tasks as possible under his or her own power.

Figure 1:
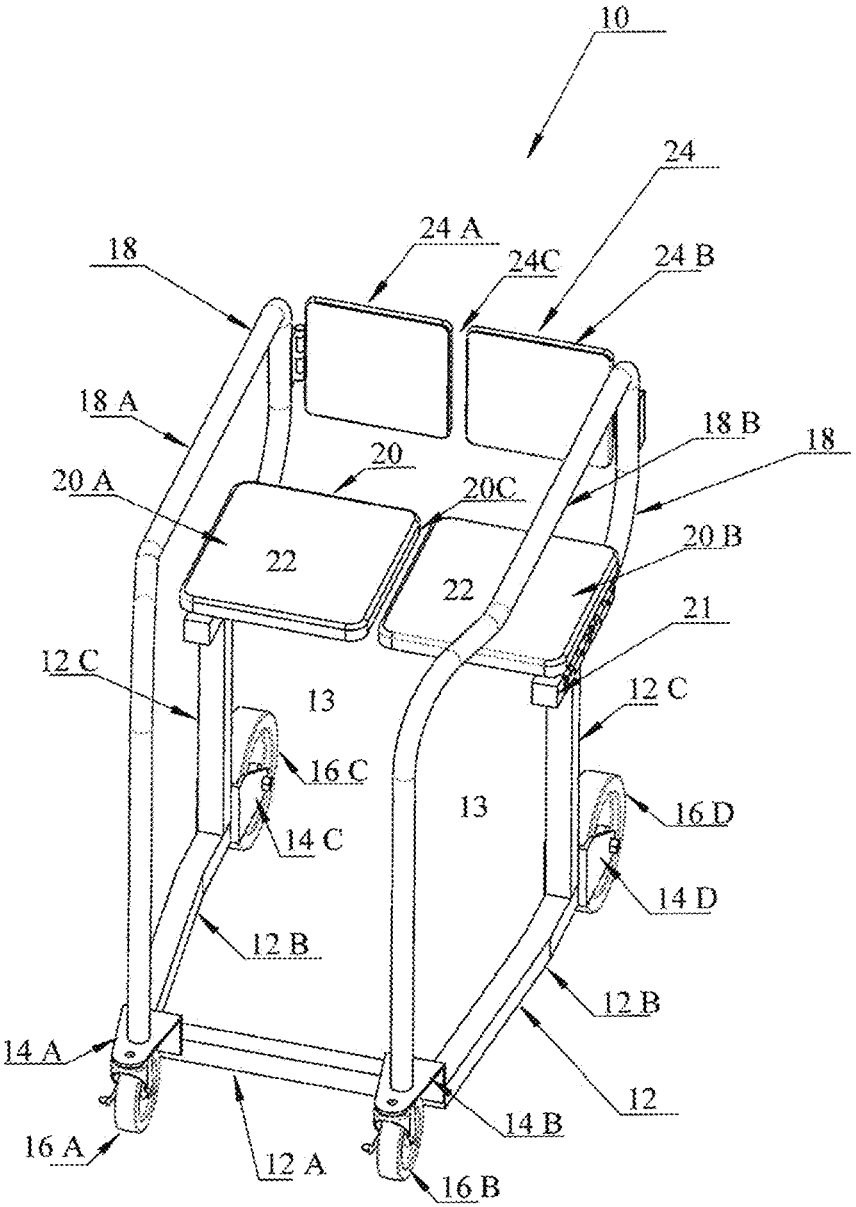
FIG. 1 illustrates a perspective view of a mobility and transfer assistance device of the present disclosure.
Figure 8:
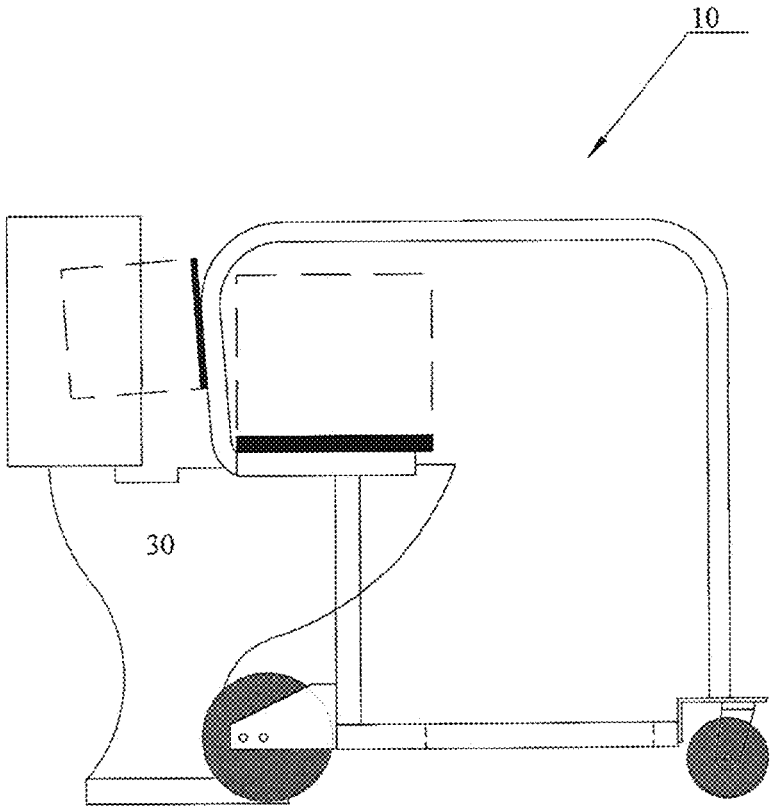

Now referring to the figures, wherein like numerals refer to like parts, FIG. 1 illustrates an embodiment of a mobility and transfer assistance device 10 according to the present disclosure. The mobility and transfer assistance device 10 comprises a frame 12. The frame 12 can have any shape but is preferably a rectangular shape, formed from bars or tubing (preferably metal), specifically a front bar 12A connected by two opposing side bars 12B, and a vertical bar 12C on an end of the side bar opposite to the front bar. The bars 12A, 12B of the frame 12 create an interior space 13 or center of the device, which accommodates the user for walking or standing. Additionally, the open back of the frame 12 provides for easy access by the user to and from the interior space 13 of the frame (FIG. 3). The front bar 12A may further be constructed to include an option to adjust the length of the front, for example the front bar may be constructed as a two-part telescoping, locking/unlocking assembly. In this manner, adjusting the length of the front bar 12A further adjusts the width of the interior space 13 of the device 10, providing more or less space depending on the needs of a particular user. Additionally, the open access of the frame 12 allows the device 10 to slide over a seating element, such as a chair, or over a toilet (FIG. 8).

Figure 7:
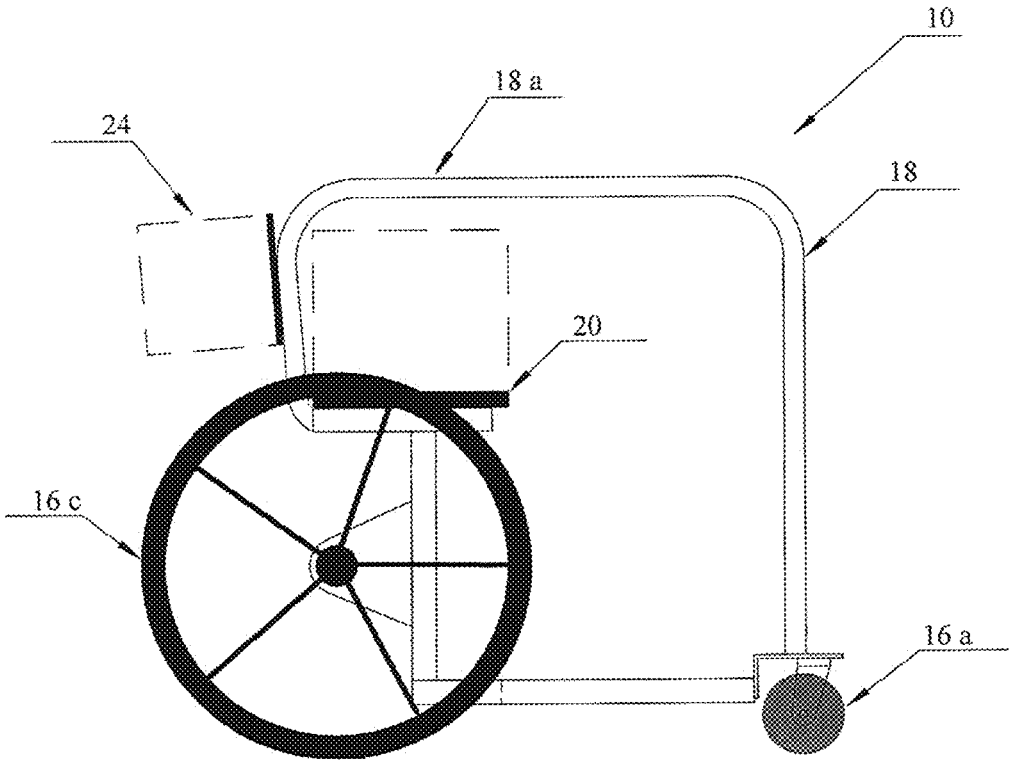
FIG. 7 illustrates another embodiment of the mobility and transfer assistance device as a wheelchair; and, FIG. 8 illustrates a side view of the mobility and transfer assistance device of the present disclosure positioned over a toilet.

The frame 12 further includes four connectors, one at each bottom corner of the frame, specifically right and left front connectors 14A, 14B, which are secured to the front 12A of the frame, and right and left rear connectors 14C, 14D, at the ends of the two opposing sides 12B of the frame. Preferably, each connector 14A, 14B, 14C, 14D is fitted with a wheel 16A, 16B, 16C, 16D providing mobility to the device 10. The device 10 can have wheels in a variety of sizes, depending on the primary use of the device. For example, a larger rear wheel 16*c*, and a smaller front wheel 16*a*, such as that used for a wheelchair, can be used (FIG. 7). Optionally, the device 10 may include only two wheels for example on the front connectors 14A, 14B only, or on the rear connectors 14C, 14D only, making the device more of a traditional walker.

Figure 2:
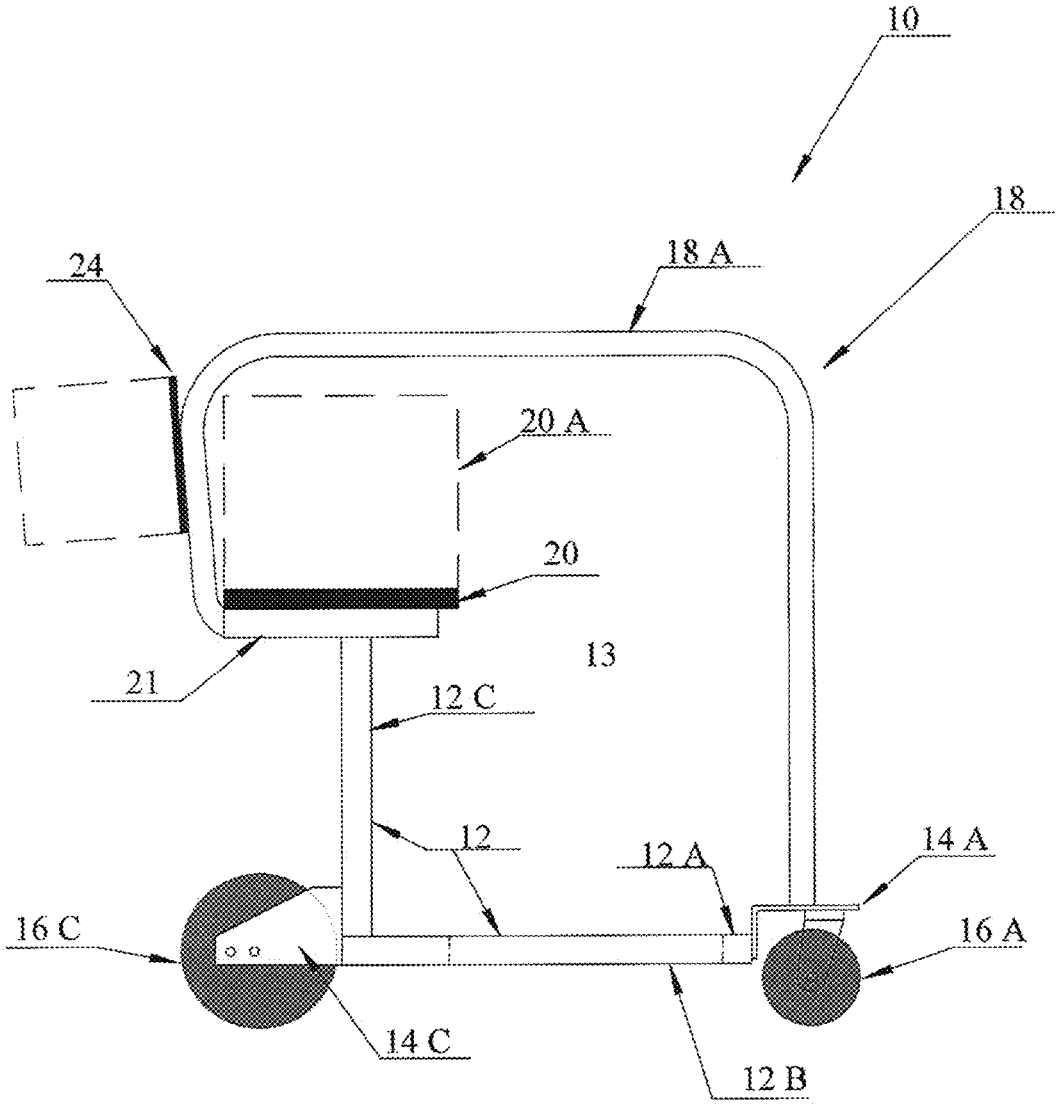
FIG. 2 illustrates a mobility and transfer assistance device of the present disclosure, and specifically a side view of the device.

As illustrated in FIGS. 1 and 2, the present device 10 includes a support structure 18, which is formed from a pair of opposing, parallel support bars, a first support bar 18A and a second support bar 18B. The parallel support bars 18A, 18B form the two opposing arm rests or supports of the device 10, extending from the rear of the device behind the seating element 20 and curving around to the front 12A of the frame. The support bars 18A, 18B are welded or otherwise secured to a base 21 on the seating element (FIG. 2) and welded or otherwise secured to the frame 12. The support bars 18A, 18B can have any suitable shape, however, a smooth rounded shape as shown in FIG. 1 is preferable for ease of use as there are no sharp edges, and for aesthetics.

The first support bar 18A and second support bar 18B are designed to provide guidance to the user, as the support bars can be gripped continuously by the user, as the user enters through the open back of the device 10 and into the center or interior space 13 of the device (FIG. 4), or when rising from the seat 20 if seated within the device. The parallel continuous support structure 18 of the present device 10 provides an advantage over other devices because of the continuous support provided by the parallel support bars 18A, 18B along either side of the user. The user is never without a support structure 18, if needed. The smooth design of the parallel support bars 18A, 18B means they can be grabbed easily by the user, as the user is transitioning from one position, such as from a chair and into the device 10. The first 18A and second 18B support bars are also used for support and guidance as the user engages the device as a traditional rollator walker. Additionally, the parallel bars 18A, 18B may be used during physical therapy as a walking device, or for doing stationary exercises with the seating element 20 and backrest 24 in the raised position.

The first 18A and second 18B support bars are ideally positioned at an average height suitable for most users to reach the bars without straining, either because the bars are too high or too low. Ideally, the height should be that when the user is standing in the interior 13 of the device 10, the user can reach down comfortably to reach the bars. In one embodiment, the support bars may be height adjustable in any manner known in the art for height adjustment. For example, the support bars 18A, 18B may be constructed in a two-part telescoping manner, so that the one section of the bar can be inserted into a second section, and then fastened so that they can be locked together in any manner known to one skilled in the art, such as a push button or slide lock engagement. The support bars 18A, 18B can then be adjusted to fit the height of a specific user.

Figure 3A:
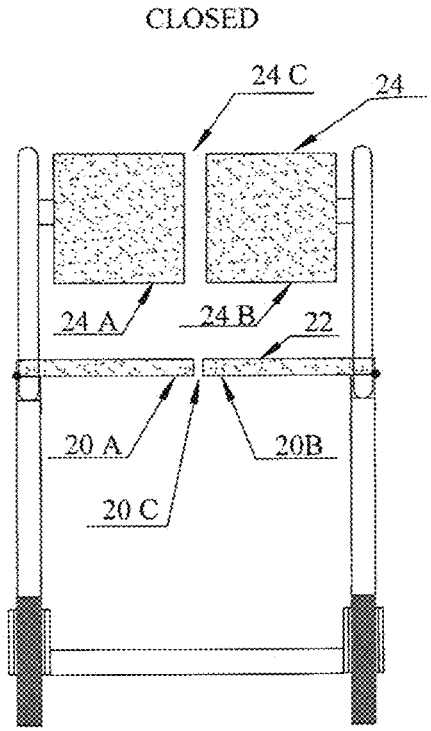
FIG. 3A illustrates a rear view of the mobility and transfer assistance device of the present disclosure with the seat and backrest in the closed, seating position.
Figure 3B:
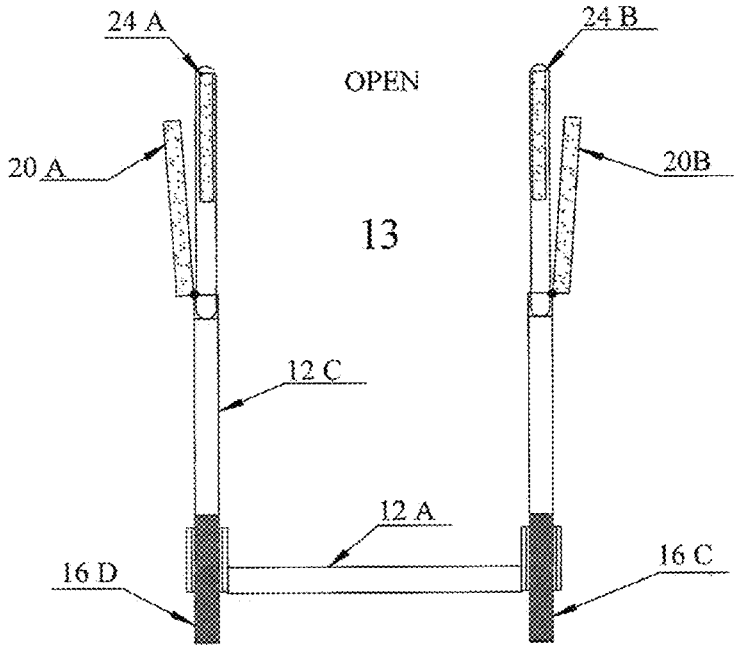
FIG. 3B illustrates a rear view of the mobility and transfer assistance device of the present disclosure with the seat and backrest in the open position.
Figure 4:
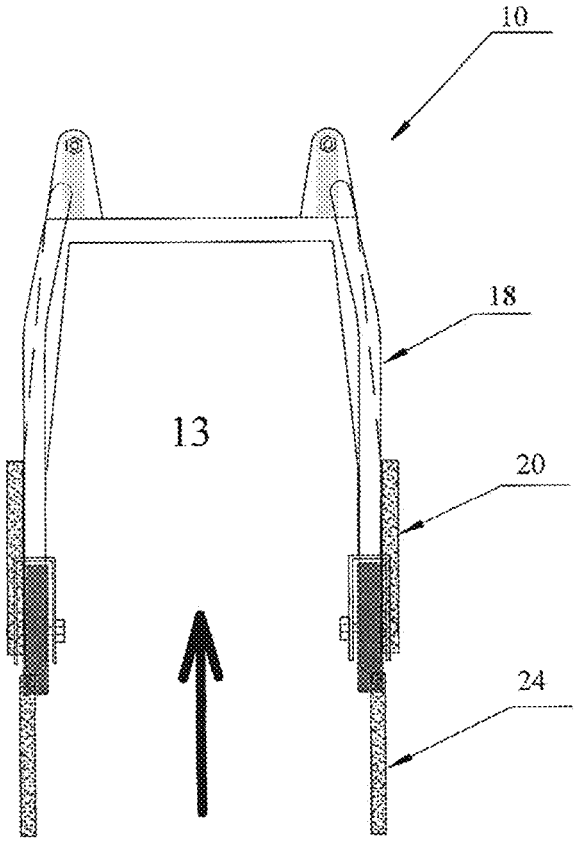
FIG. 4 illustrates a top view of the mobility and transfer assistance device of the present disclosure with the seat and backrest in the open position showing access to the interior of the device.

As illustrated in FIGS. 1 and 3A and 3B, the present mobility and transfer assistance device 10 can also function as a chair, either as a stationary chair or as a mobile chair. The device 10 includes a seating element 20, having a seating surface 22. Additionally, the device 10 further includes a separate backrest 24. In one embodiment, the seating element 20 is designed as a two part, split seat, having a first section 20A and a second section 20B of the seat, each section pivotally or hingedly attached at one side or edge to a base 21 supported on the vertical bar 12C of the frame 12 (FIG. 2). The attachment is through known attachment and hinge elements, which permit the individual seat sections 20A, 20B to pivot between a downward horizontal position and an upright vertical position (FIGS. 3A and 3B). The first 20A and second 20B seat sections are spaced apart from one another forming a center opening 20C, and independently moveable from one another (FIGS. 1 and 3A). An advantage of the present device 10 is that the seat sections 20A, 20*b* are cantilevered, meaning the seat sections are attached along one edge or side to the frame 12, and there is no additional support or obstruction directly under the seat sections so the seat sections are completely out of the way for the user to enter the interior space 13 of the device when the seat sections are in the upright vertical position (FIGS. 3B and 4). This seating configuration provides a clear, accessible pathway for the user to enter the device. Additionally, when the seat sections 20A, 20B are in the downward, seating position, there is no support or obstruction under the seat sections, which permits the device 10 to be moved close to another object, such as a chair, bed, or over a toilet (FIGS. 3B and 6).

The present device further includes a backrest 24. As shown in FIGS. 1 and 2A, the backrest 24 comprises two sections, a first section 24A and a second section 24B, which are spaced apart from one another forming a center opening 24C, the sections each pivotally or hingedly attached along an outer edge to opposing support bars 18A, 18B of the support structure 18. The first section 24A and the second section 24B can be attached to the support structure 18 using any known attachment elements that permit the backrest sections to pivot about an axis of the support structure independently from one another. Optionally, the seat sections 20A, 20B and backrest sections 24A, 24B may also be attached using a spring loaded or spring biased element, wherein, for example, when the user lifts off the seating surface 22, the seat sections spring upward into an upright open position alongside the opposing support bars 18A, 18B. Another option may to include a locking element, so that the seat and/or backrest may be locked, in either the upward open position, or downward closed position.

Figure 5:
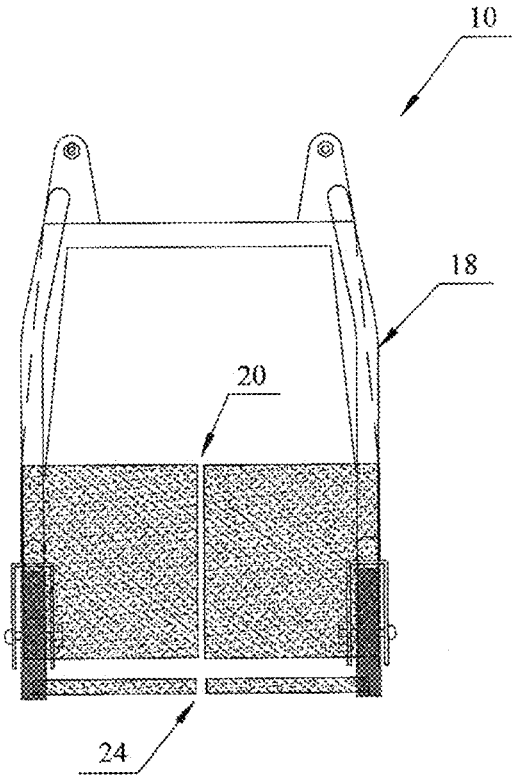
FIG. 5 illustrates a top view of the mobility and transfer assistance device of the present disclosure with both the seat and backrest in the closed position.

The moveable seating element 20 and backrest 24 of the present disclosure provides advantages over standard walker and wheelchair devices. As illustrated in FIGS. 3B and 4, when the seat sections 20A, 20B and backrest 24A, 24B move completely out of the path of the user, the user can step into the interior space 13 the device 10 from the rear section of the device, and using the parallel bars 18, easily move into the interior space of the device (FIG. 4). The cantilevered seat sections 20A, 20*b* have no obstruction directly under the seats, so that they are completely out of the way when in the upright position. The cantilevered seat sections 20A, 20B can be lowered to a horizontal position, and the backrest sections 24A, 24B swung back into position forming the backrest 24 if the user wishes to sit down on the device (FIG. 5). Alternatively, the seating element 20 and backrest 24 can remain in the open or upright position, and the user can use the device 10 as a walker.

Figure 6:
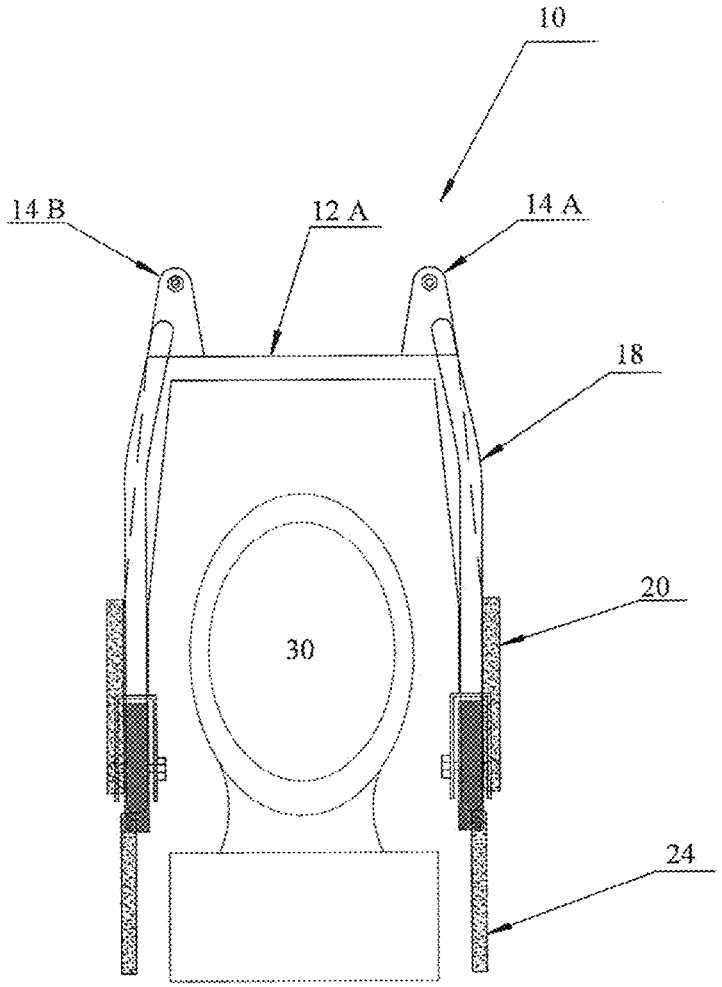
FIG. 6 illustrates a top view of the mobility and transfer assistance device of the present disclosure with the seat and backrest in the open position, and wherein the device is positioned over a toilet.

Additionally, as shown in FIG. 6, the movable seating element 20 and backrest 24 permit the user to position the device 10 over a toilet 30 as shown in FIGS. 6 and 8. Similarly, the user can move the device 10 to within a walk-in shower, and then exit the device by lifting the seating element 20 and moving the backrest 24 around to the sides of the device. The device 10 can also be used to position the user over a chair, couch or near a bed, where the seating element 20 and backrest 24 can be moved, pivoted upright out of the way, permitting the user to easily access the chair, couch or bed. In this manner, the device 10 provides a degree of mobility, independence and dignity for the user.

The present mobility and transfer assistance device 10 is designed to be used with those patients with limited mobility, and to perhaps encourage those with limited mobility to continue to perform some daily tasks with limited intervention by another person or caregiver. For example, the present device 10 can be used to assist a person out of bed, by simply moving the device, having an open seating element 20 and backrest 24 as close to the edge of the bed as possible. The user can then grab either or both of the parallel support bars 18A, 18B for leverage and, possibly with minimal assistance, move into a standing position. The patient would then take one or two steps forward into the interior space 13 of the device, and either continue forward, using the device as a walker, or the seating sections may be lowered and the backrest moved into position, so that the patient can take a seated position on the device. Either way, the addition of the parallel support bars 18A, 18B, and pivotally moveable seating element 20 and backrest 24, provide the present device with advantages including conversion between standing, moving and seating, as well as, continuous support and ease of use to the patient to encourage and support continued mobility while relieving some the requirement for assistance.

For example, in order to assist the patient into bed, the present mobility and transfer assistance device 10 can be maneuvered backward to the edge of a bed. The backrest sections 24*a*, 24B can then be pivoted opened, while the patient stands within the interior space 13 of the device, using the parallel support bars 18A, 18B for leverage and stability. Either one or both sections 20A, 20B of the seating element 20 can then be raised to the open position, and the patient can take a step or two backwards, again always supported by the parallel support bars 18A, 18B, until the patient reaches the edge of the bed. The patient can then lower him/herself onto the bed. The present device 10 and particularly the cantilevered seating element 20 enables the patient to utilize the supporting features of the device to move onto and off of another object, such as a chair or bed, rather than relying completely on assistance from another person.

Unlike with a convention wheelchair, which can be hard to maneuver in a tight space such as a bathroom, the present mobility and transfer assistance device 10 can be easily positioned over a toilet 30 (FIGS. 6 and 8). Once in position, the patient can stand again using the parallel support bars 18A, 18B for stability and leverage, the seating element sections 20A, 20B can be opened upright into the open position, and, once ready, the patient can then take a seat on the toilet. Once completed, the patient simply uses the parallel support bars 18A, 18B as leverage to lift him/herself from the toilet seat. Use of the parallel support structure 18 in combination with the ability of the mobility and transfer assistance device 10 to be moved easily over a toilet 30, or any other seating item, such as a chair, bed or couch, minimizes the stress on both the patient and the caregiver. Additionally, because of the open structure of the device 10, the device can also be used for positioning closer to a sink, and also for entering and exiting a walk-in shower.

For example, when entering shower enclosure, the mobility and transfer assistance device 10 can be maneuvered backwards in to shower enclosure (not shown) to the shower seat (not shown). Using the parallel support structure 18, the patient can then stand, while either one or both seating sections 20A, 20B are raised and/or the backrest sections 24A, 24B are opened, as needed. The patient can then take a step or two back to the shower seat, always supporting him or herself with the assistance of the continuous the parallel support bars 18A, 18B. Once seated, or otherwise safely within the shower, the mobility and transfer assistance device 10 can be removed. The reverse steps can be taken to assist the patient from leaving the shower enclosure.

The ease of design of the present mobility and transfer assistance device 10 means it can be customized as needed. For example, the parallel support structure 18 can be designed so that the height of the parallel bars can be raised or lowered, such as through use of a telescoping structure and locking mechanism. Additionally, the front bar 12*a* of the frame, may include a two piece, telescoping configuration, that can be extended and retracted as necessary, to widen or narrow the interior space 13 of the device. The height of the seating element 20 may be adjustable, particularly to ensure that the seat fits over a standard or chair-height toilet. The present mobility and transfer assistance device 10 may be equipped with a foot brake (not shown); however, it should be understood that any common braking system, including a hand brake or lever brake on a back wheel, as with a standard wheelchair, or a hand brake, may be incorporated into the device. The frame 12 and components of the mobility and transfer assistance device 10 may be constructed from an all welded, strong but lightweight material including steel or aluminum. The material should be able to withstand exposure to water, including through use outside and also in a shower or bathroom.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

The invention claimed is:

1. A hybrid mobility and transfer device comprising:

a frame comprising a horizontal bottom front bar connected to two opposing side bars, wherein each side bar further includes a vertical bar opposite to the front bar, the vertical bars defining an interior space of the device;

a support structure connected to the frame, the support structure comprising a first support bar connected at a first end to a front of the frame and at a second end to a first base supported by a first vertical bar and an opposing second support bar connected at a first end to a front of the frame and at a second end to a second base supported by a second vertical bar, the second support bar positioned parallel to and spaced apart from the first support bar;

a vertical backrest attached to each of the first support bar and the second support bar, the vertical backrest spanning between the first support bar and the second support bar; and, a seating element having a first cantilevered section and a second cantilevered section, each section connected along an opposing edge to the first base and the second base, respectively, the seating element providing unobstructed access beneath the seating element to the interior space when the first cantilevered section and second cantilevered section are in a horizontal seating position.

2. The hybrid mobility and transfer device of claim 1 wherein the first support bar and the second support bar each define a continuous shape from the first end to the second end.

3. The hybrid mobility and transfer device of claim 1 wherein the backrest comprises a first section and a second section wherein the first section is spaced apart from the second section forming a center opening between the sections.

4. The hybrid mobility and transfer device of claim 3 wherein the first section of the backrest is pivotally attached along an edge to the first support bar and the second section of the backrest is pivotally attached along an edge to the second support bar.

5. The hybrid mobility and transfer device of claim 3 wherein the first section of the backrest is moveable independently from the second section of the backrest.

6. The hybrid mobility and transfer device of claim 1, wherein the first cantilevered section is spaced apart from the second cantilevered section forming a center opening between the sections.

7. The hybrid mobility and transfer device of claim 1 wherein the first cantilevered section of the seating element is independently moveable from the second cantilevered section of the seating element.

8. The hybrid mobility and transfer device of claim 1 wherein the first cantilevered section and second cantilevered section of the seating element are moveable between an upward vertical position and the horizontal seating position.

9. The hybrid mobility and transfer device of claim 1 wherein the first cantilevered section of the seating element is pivotally attached along the opposing edge to the first base.

10. The hybrid mobility and transfer device of claim 1 wherein the second cantilevered section of the seating element is pivotally attached along the opposing edge to the second base opposite the first section.

* * * * *